United States Patent [19]

Martinsson

[11] 4,054,281

[45] Oct. 18, 1977

[54] CLAMPING DEVICE FOR HOLDING WORKPIECES

[76] Inventor: Per Erik Bertil Martinsson, N. Fiskargatan 1 F, 803 50 Gavle, Sweden

[21] Appl. No.: 735,511

[22] Filed: Oct. 26, 1976

[51] Int. Cl.[2] ..... B25B 5/14

[52] U.S. Cl. ..... 269/110; 269/118; 269/155; 269/264

[58] Field of Search ..... 269/104, 110, 118, 135–136, 269/152–156, 218, 264

[56] References Cited

U.S. PATENT DOCUMENTS 3,113,508 12/1963 Trachtman ..... 269/118

*Primary Examiner*—Robert C. Watson

*Attorney, Agent, or Firm*—Diller, Brown, Ramik & Wight

[57] ABSTRACT

The present invention relates to a clamping device of the kind comprising at least two jaws, at least one of which being movable to clamp one or more workpieces between the jaws, and at least one lever being pivotable in relation to the jaws and having two arms, one of which being actuated when moving the jaws towards each other in order to tend to pivot the lever and the other being arranged, when actuating said first arm, to exert a clamping force on the workpieces substantially perpendicularly to the direction of movement of the movable jaw, wherein said first arm of said lever is located between one of the jaws and the workpieces in order to be subjected to a compressive force via said workpieces when moving the jaws towards each other.

12 Claims, 5 Drawing Figures

CLAMPING DEVICE FOR HOLDING WORKPIECES

The present invention relates to a clamping device of the kind comprising at least two jaws, at least one of which being movable to clamp one or more workpieces between the jaws, and at least one lever being pivotable in relation to the jaws and having two arms, one of which being actuated when moving the jaws towards each other in order to tend to pivot the lever, and the other being arranged, when actuating said first arm, to exert a clamping force on the workpieces substantially perpendicularly to the direction of movement of the movable jaw.

Devices of the kind above are previously known by the U.S. Pat. No. 2,976,776 and the French Pat. No. 7,115,020. However, these devices are suffering from several disadvantages. By way of example, the levers in the above U.S. patent specification are arranged to obtain their clamping force by springs, whereby the utility of the device is limited and the possibility of varying the clamping force of the levers does not exist unless the strength of the springs is changed. In the device according to the above French patent specification, a lever is operable through a complicated thread and link system leading to raised costs for manufacture and maintenance and an obvious risk of frequent breakdowns.

The object of the invention is to eliminate the above disadvantages and provide a simple and yet effective clamping device. This object is obtained by said first arm of said lever being located between one of the jaws and the workpieces in order to be subjected to a compressive force via said workpieces when moving the jaws toward each other.

With reference to the appended drawings, a more specific description of embodiments of the invention cited as examples will follow hereinafter. In the drawings.

Figure 1:
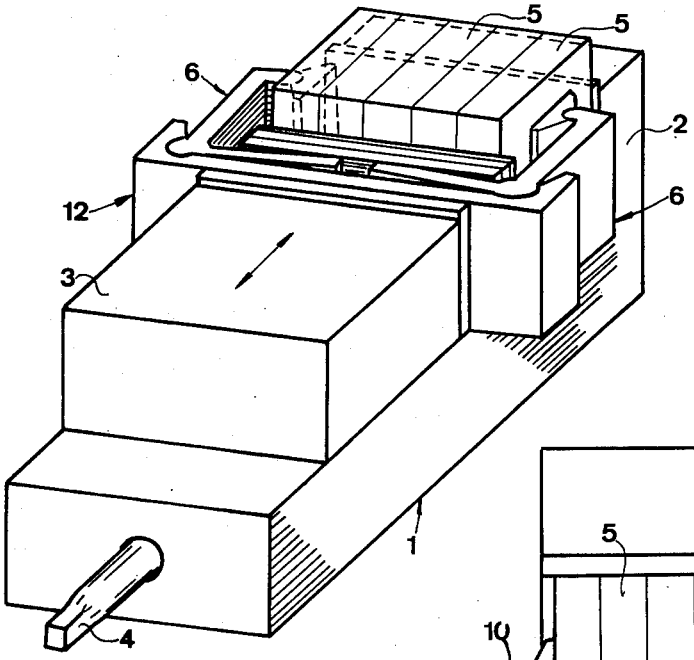
FIG. 1 is a perspective view of the device according to the invention, a number of workpieces being clamped.
Figure 2:
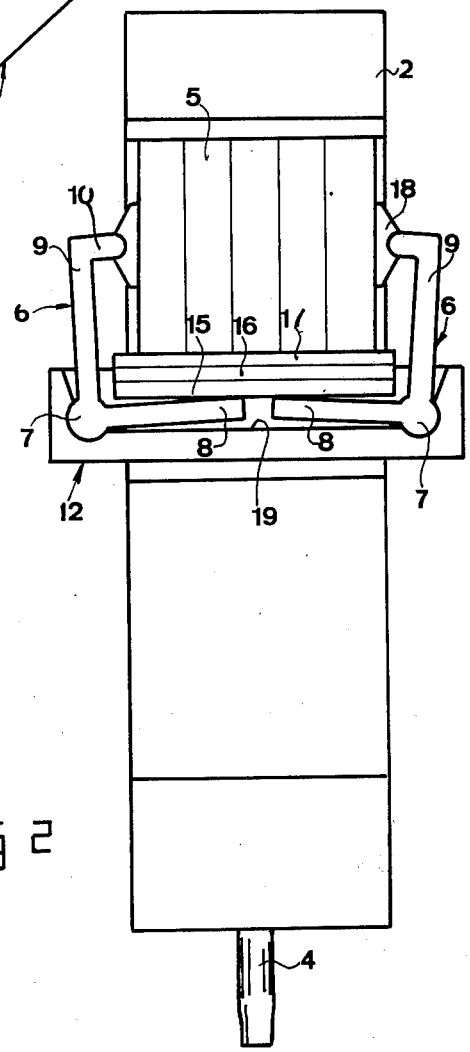
FIG. 2 is a view from above of FIG. 1.
Figure 3:
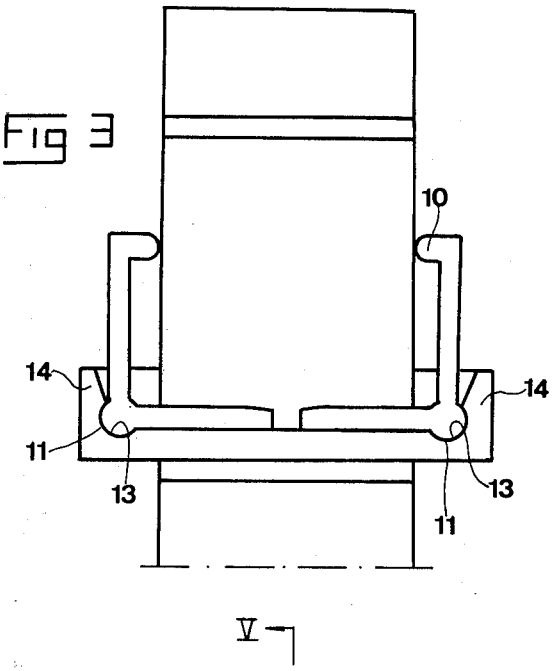
FIG. 3 is a view similar to FIG. 2, the workpieces being removed.

In FIGS. 1 to 3, a vice is generally designated by 1. The same comprises a jaw 2, which is rigidly connected to or alternatively made integral with the frame of the vice. A second jaw 3 is movable on said frame. More specifically, the jaw 3 is displaceable towards and away from the jaw 2 by means being conventional and therefore not shown, e.g. screw and nuts means, which are operable by rotating the bar 4 to clamp between the jaws a number of workpieces 5, which in the example are parallelepipedic.

At least one lever 6 is pivotable in relation to the jaws and has two arms 8; 9, one of which 8 being located between the jaws 2, 3 and actuatable via said workpieces in order to tend to pivot the lever 6 when moving the jaws closer to each other, and the other 9 being arranged, when actuating said first arm, to exert a clamping force on the workpieces substantially perpendicularly to the direction of movement of the movable jaw 3. More specifically, two levers are symmetrically arranged to exert clamping forces on the workpieces 5 in essentially opposite directions and essentially perpendicularly to the direction of movement of the movable jaw 3.

The levers 6 are essentially shaped in right-angled form and supported in a holder 12 arranged in connection with the movable jaw 3, said holder being integral with, permanently connected to, detachably mounted to or without any direct attachment to the movable jaw. The holder 12 is movable with the movable jaw 3 in a direction towards and away from the fixed jaw 2. The elbows 7 of the levers 6 are situated in seats 13 provided in the holder 12 and in the embodiment shown, the elbows 7 are designed with a cross-sectionally part-circular, convex surface 11 and the seat 13 with a corresponding cross-sectionally part-circular, concave surface, although other arrangements of course are possible, such as shaft and hole, for supporting pivotally the levers about an essentially vertical axis.

As appears from FIGS. 1 to 3, the holder 12 is designed with an essentially planar, countersunk portion 19 between the seats 13 in order to provide space for the pivoting of the arms 8 of the levers 6. Adjoining said planar portion 19, two branches 14 extend on both sides of the holder 12 and in the direction towards the fixed jaw 2, said branches being bevelled on the inner sides in order to provide space for the second arms 9 of the levers in the pivoting movement. The seats 13 are situated in the cross points between the portion 19 and the branches 14 of the holder 12.

Between the workpieces 5 and the first arms 8 of the levers one or more inserts, spacers or pads 15, 16, 17 are insertable.

The second arms 9 of the levers are provided with noses 10 forming an angle to the arms 9 and being connected to or engageable with pads 18 intended to contact the workpieces 5 or the spacers inserted between the second arms 9 of the levers and the workpieces 5 and not shown in the drawings.

The device according to the invention is used in the following manner. Initially, the jaws 2, 3 are moved away from each other to enable insertion of a desired number of workpieces 5 between the jaws, more specifically between the jaws 2 and the arms 8 and 9 of the levers. It should be noted that at least one insert 15, 16 or 17 should be present between the first arms 8 of the levers and the workpieces in order to evenly distribute the clamping force onto the workpieces. Thereafter a judgement is made whether spacers are required between the workpieces and the first arms 8 of the levers 6 and between the workpieces and the second arms 9 of the levers. It is evident that the spacers between the workpieces 5 and the second arms 9 of the levers should be inserted in such a way, that the ends of the first arms 8 of the levers in a tensioned state are present at a certain distance from the central portion 19 of the holder 12 to enable the pivotal movement of the levers. Further, it is evident that possible spacers 15, 16, 17 between the workpieces 5 and the first arms 8 of the levers 6 should be inserted so that the second arms 9 of the levers, more specifically the pads 18, are engaging the outermost workpieces essentially centrally.

Then the movable jaw 3 and thereby also the holder 12 and the levers 6 are tightened in a direction towards the fixed jaw 2 by operating the bar 4. In the tightening, the first arms 8 of the levers 6 will be actuated to pivot or rotate the levers 6 in their seats 13 in the holder 12, whereby the second arms 9 of the levers 6 will exert clamping forces on the workpieces in essentially opposite directions and essentially perpendicularly to the direction of movement of the movable jaw 3. Thus, the workpieces 5 will be clamped efficiently from four directions. When the workpieces have been machined, e.g. by cutting, boring etc, the jaws 2, 3 are moved away from each other, whereby the engagement between the levers 6 and the workpieces ceases. Then the machined workpieces are removed and further operations carried out in an analoguous manner.

Figure 4:
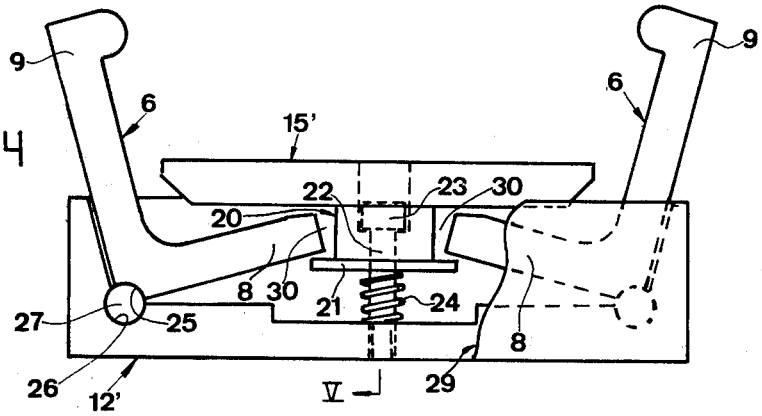
FIG. 4 is a view from above of an alternative embodiment.
Figure 5:
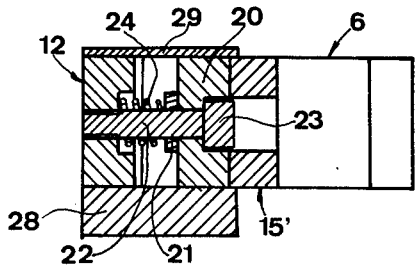
FIG. 5 is a section along the line V—V in FIG. 4.

In FIGS. 4 and 5, an alternative embodiment of the invention is shown. The components of FIGS. 4 and 5 are intended to be combined with a vice in accordance with the embodiment of FIGS. 1–3. An insert 15' between the first arms 8 of the levers and the workpieces is guided in relation to the holder 12' and the jaws 2, 3. The insert 15' is provided with a projection 20 directed towards the holder 12 and extending between the ends of the first arms 8 of the levers 6. On the end of the projection 20, a plate 21 is provided projecting beyond the sides of the projection 20. The projection 20 and plate 21 of the insert 15' form two guides 30 engaging the ends of the first arms 8 of the levers. The insert 15', and thereby the ends of the first arms 8 of the levers, is spring-loaded in a direction away from the holder 12, the levers 6 thereby having their second arms 9 turned out in the directions away from the space or place intended for the workpieces when the levers are not under tension, as is evident from FIG. 4. More specifically, a pin 22 is arranged in a hole in the insert 15' and at one end thereof secured to the holder 12', the other end of said pin 22 being provided with a head 23 for retaining the insert 15' in the correct position. A helical spring 24 is arranged around the pin 22 and acts between the holder 12' and the insert 15'. The pin 22 is preferably detachably secured to the holder 12', e.g. by a thread connection, bayonet-mount etc, to allow dismantling, service and cleaning of the components.

In the embodiment of FIGS. 4 and 5, the pivot support for the angle-shaped levers 6 includes cross-sectionally part-circular, convex surfaces 25 of the levers intended to rest against a pin 27 inserted into a bore 26 made in the holder 12', the limiting surface of said bore 26 merely surrounding the pin 27 partially. Preferably, the bore 26 is situated in the holder 12' in such a manner that the pin 27 may be withdrawn in an axial direction only. The exchangeable pins 27 are preferably made of a material softer than the material of the levers and the holder.

As further appears from FIGS. 4 and 5, the holder 12' is provided with a bottom plate 28 and a cover plate 29 holding and guiding the levers 6. The cover plate 29 partially covers the levers 6 and is detachably secured to the holder 12', e.g. by screws, in order to allow withdrawal of the pins 27.

The advantages of the invention are evident in that an extremely efficient clamping of workpieces is possible. Although the invention is extremely efficient when clamping only one workpiece, special advantages lie in the capability of efficient simultaneous clamping of a plurality of workpieces, which may be machined simultaneously. The device according to the invention may advantageously be used for workpieces of different forms, such as rounded or irregularly shaped workpieces, due to the excellent clamping capability of the device. For clamping purposes normally requiring a chuck, the device according to the invention may preferably be used supported rotatably or mounted on a circular feed device. The invention is obviously not merely limited to the embodiments described and shown. Thus, the holder 12 for the levers 6 may alternatively be arranged in conjunction with the fixed jaw. In some instances, it may be suitable to use merely one lever and to arrange a fixed dolly instead of the second lever; said dolly may be connected to either the movable or the fixed jaw. Thus, the number of levers and jaws may be varied within the scope of the invention, it for instance being possible to use four levers, e.g. two levers at each jaw. It is conceivable to modify the device for use in chucks, in which case the levers may be curved or otherwise appropriately shaped. Contact members may of course be hingedly secured to the ends of the second arms 9 of the levers. Also other modifications are conceivable within the scope of the appended claims.

What I claim is:

1. A clamping device of the kind comprising at least two jaws arranged in spaced relation and defining a workpiece receiving space, means mounting said jaws for relative movement to clamp one or more workpieces between the jaws, and at least one lever, means mounting said lever for pivoting in relation to said jaws, said lever having two arms, a first of said arms being positioned for actuation when said jaws move towards each other in order to tend to pivot said lever, a second of said arms being arranged to exert a clamping force on a workpiece substantially perpendicularly to the direction of relative movement of said jaws in response to actuation of said first arm, said first arm of said lever being located between one of said jaws and said workpiece receiving space for being subjected to a compressive force via workpieces in response to movement of said jaws towards each other to effect pivoting of said lever.

2. A clamping device according to claim 1, wherein said means mounting said lever includes a a holder arranged at one of said jaws.

3. A clamping device according to claim 2, wherein the support for the lever includes a cross-sectionally part-circular, convex surface on the lever and a corresponding cross-sectionally part-circular, concave surface on the holder.

4. A clamping device according to claim 2, wherein the support for the lever includes a cross-sectionally part-circular, concave surface on the lever, said surface being arranged to rest on a pin inserted into a bore made in the holder, the limiting surface of said bore merely surrounding the pin partially.

5. A clamping device according to claim 1, wherein one or more inserts, spacers or pads are insertable between the workpiece receiving space and the first arm as well as the second arm of the lever.

6. A clamping device according to claim 1, wherein there are two of said levers and said levers are symmetrically arranged to exert clamping forces on workpieces in essentially opposite directions and essentially perpendicularly to the direction of movement of the movable jaw.

7. A clamping device according to claim 1, wherein there is an insert between said one arm of the lever and said workpiece receiving space, and means guiding said insert in relation to the jaws.

8. A clamping device according to claim 7, wherein the guided insert comprises a guide engaging the end of the first arm of said lever.

9. A clamping device according to claim 8, wherein the insert, and thereby the end of the first arm of the lever, is spring-loaded in a direction away from the holder, the lever thereby having its second arm turned out in a direction away from the place intended for the workpieces when the lever is not under tension.

10. A clamping device according to claim 9, wherein at least one pin is arranged in a hole in the insert and has one end thereof secured to the holder, the other end of said pin being provided with a head for retaining the insert in the correct position, and a helical spring is arranged around the pin and acts between the holder and the insert.

11. A clamping device according to claim 2, wherein the holder is provided with a cover partially covering and guiding the lever.

12. A clamping device according to claim 1 wherein said arms are rigidly interconnected for movement in unison.

* * * * *